US005763806A

United States Patent [19]

Willis

[11] Patent Number: 5,763,806

[45] Date of Patent: Jun. 9, 1998

[54] METHOD AND APPARATUS FOR MIDIFYING VINTAGE ORGANS AND PIANOS

[76] Inventor: Raymon A. Willis, 419 E. Thirty-Third St., Savannah, Ga. 31401

[21] Appl. No.: 679,926

[22] Filed: Jul. 15, 1996

[51] Int. Cl.[6] ..... G10H 17/00

[52] U.S. Cl. ..... 84/645; 84/171

[58] Field of Search ..... 84/170, 171, 174, 84/221, 220, 219, 381, 645

[56] References Cited

U.S. PATENT DOCUMENTS 4,686,880 8/1987 Salani et al. ..... 84/645 X 4,790,230 12/1988 Sanderson .

5,440,072 8/1995 Willis ..... 84/645

5,459,282 10/1995 Willis ..... 84/645

*Primary Examiner*—William M. Shoop, Jr.

*Assistant Examiner*—Jeffrey W. Donels

*Attorney, Agent, or Firm*—Jim Zegeer, Esq.

[57] ABSTRACT

A system for rejuvenating old keyboard instruments has an array of key sensor switches which are individually adjustable in a horizontal plane to accommodate varying angulations of the keys behind the balance rail of the keyboard and each key sensor switch includes a friction retained sensor probe which enables a rapid and accurate accommodation of uneven keys.

15 Claims, 6 Drawing Sheets

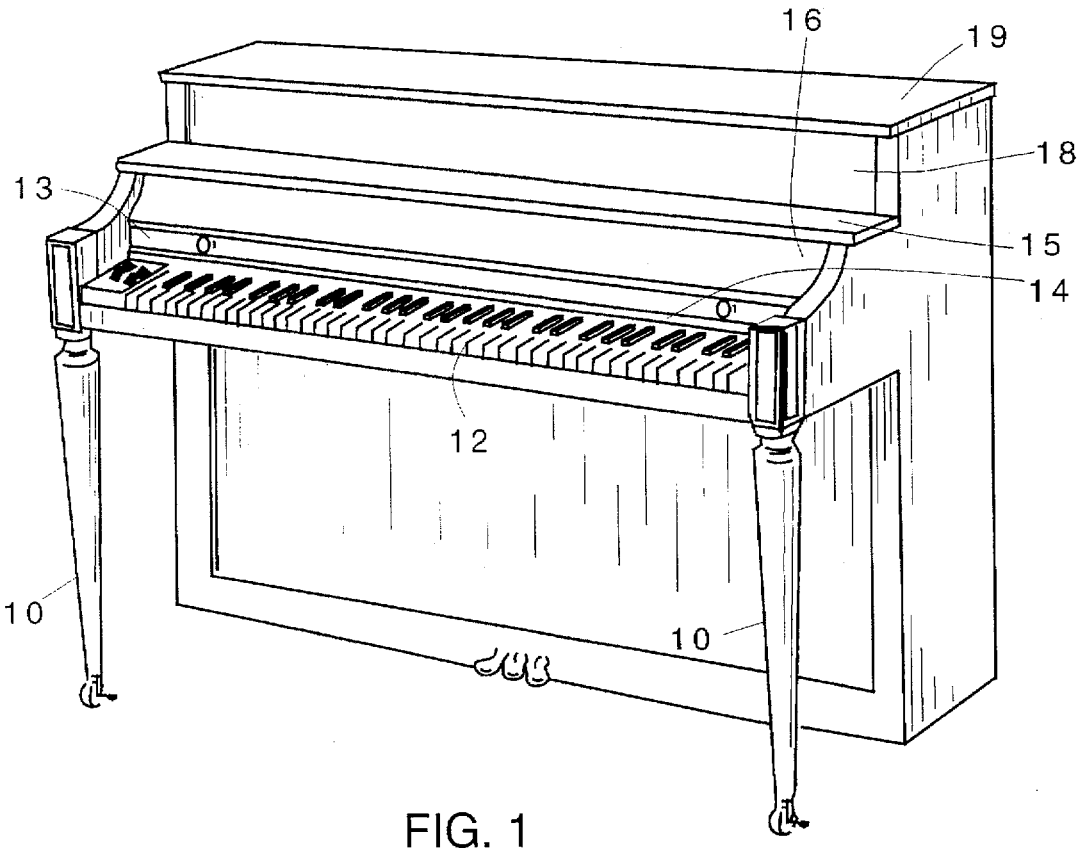
FIG. 1
FIG. 2
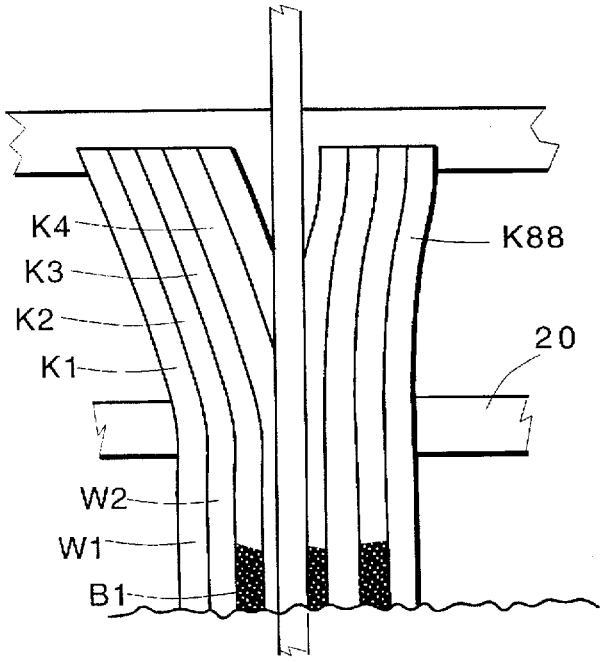

FIG. 5A
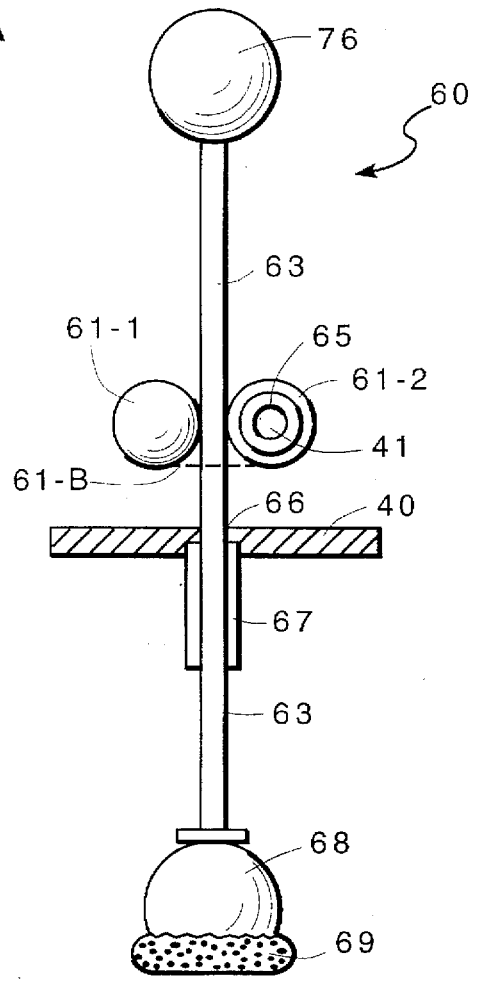
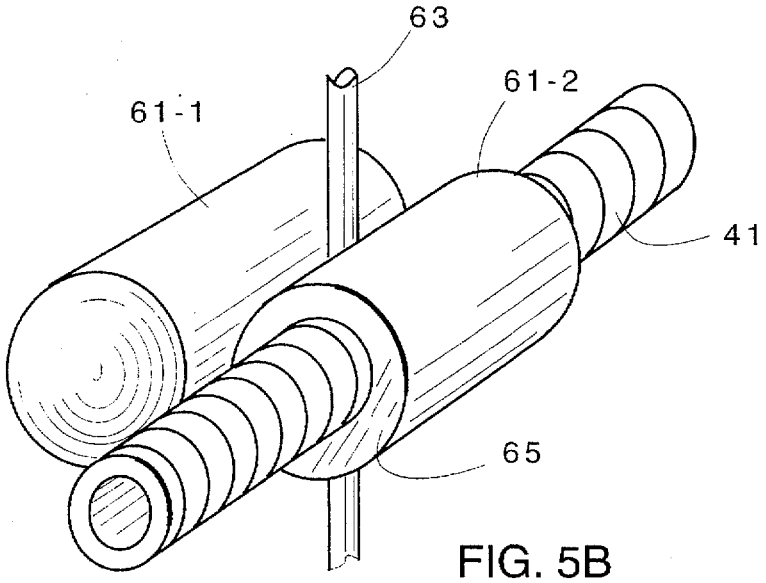
FIG. 5B

METHOD AND APPARATUS FOR MIDIFYING VINTAGE ORGANS AND PIANOS

BACKGROUND OF THE INVENTION

In my U.S. Pat. Nos. 5,440,072 and 5,459,282 I disclose method and apparatus for easily and quickly upgrading old pianos and organs to MIDI standards at relatively low cost. In my above-identified patents I achieve this objective without in anyway materially altering the existing musical instrument by installing linear arrays of key actuation sensors from above and behind the balance rail and when the keys are uneven relative to a horizontal plane due to aging or wear, I disclose vertically adjusting individual ones of the key actuation sensors in a vertical direction to accommodate any of the out-of-line keys and thereby attend to any keys which may be out of a horizontal plane due to aging or wear.

THE PRESENT INVENTION

Although the portions of the keyboard that are utilized by the musician, e.g. all of the white keys and all of the black keys, are parallel on the musician's side of the balance rail in almost all keyboard instruments, but in pianos the key portions behind the balance rail and under the music shelf can vary with different makes of pianos. Typically, the piano keys are pivoted on the balance rail which is in the space behind the music shelf drop and the music shelf itself and, if the piano is provided with a fallboard behind the fallboard. The keys are usually grouped in octaves and, according to the piano manufacturer, different key octaves diverge or are angled from being parallel. Usually, keys in the same octave are at the same angle, but different manufacturers may have different splits for the different octaves. The present invention provides a key actuation and expression effect sensing mechanism which is easily adjustable and adaptable to accommodate the vagaries of the different piano manufacturers. In addition, I have provided a novel technique and structure for accommodating the unevenness or non-level keys for older pianos and organs.

According to one preferred embodiment of the present invention, a rigid bar member carries a plurality of key sensor switches which are individually adjustable in a horizontal plane to accommodate the different piano key angulations provided by different manufacturers. Each key sensor switch includes a cantilever conductive spring mounted on a circuit board and having a first conductor member positioned below and in electrical contact with the cantilever conductive spring and a second conductor member mounted at distance (or "gap") above the cantilever conductive spring such that the first and second conductor members and cantilever conductive spring constitute a break-gap-make switch. The breaking of the circuit with the first conductor member is an indication of the actuation of the switch, and the difference in timing between the travel time of the conduct and cantilever conductive spring member between the first conductor member and making contact with the second conductor member is a measure of the expression effect implemented by the musician in striking the key. In other words, the travel of the cantilever conductive spring member in the gap between the first and second conductor members is a measure of the force utilized by the musician in striking that particular key.

Each key switch includes a key-engagement probe member and a friction member securing the key-engagement probe on the free end of the cantilever conductive spring. Each probe member can be pushed in its friction retention mounting into sensing engagement with its respective key on the old keyboard musical instrument and be retained in the proper and precise sensing engagement, thereby accommodating uneven wear in the keys.

Thus, the major objective of the invention is to provide an improved system for MIDIfying or bringing up to MIDI standards old keyboard musical instruments.

Another object of the invention is to provide key actuation sensor means which are individually adjustable: (1) in a horizontal plane to accommodate the diverging angulations of the keys for the different octaves of the piano and (2) vertically to accommodate uneven wear in old keys.

Another object of the invention is to provide such a system which can be rapidly and expeditiously applied to existing musical instruments by untrained and unsophisticated personnel. It does not require removal of the keys or keyboard from the instrument, nor does it require cutting slots, boring holes and the like for the sensors.

Another object of the invention is to provide such a system which is low in cost.

BRIEF DESCRIPTION OF THE DRAWINGS

The above and other objects, advantages and features of the invention will become more apparent when considered with the following specification and accompanying drawings wherein:

FIG. 1 (prior art) shows a typical acoustic piano keyboard instrument;

FIG. 2 (prior art) is a top plan view of the key portion below the music shelf;

FIG. 5 is an end view of the key sensor switch;

FIG. 5B is an enlarged perspective view of the scroll spring friction feature;

DETAILED DESCRIPTION OF THE INVENTION

Figure 3:
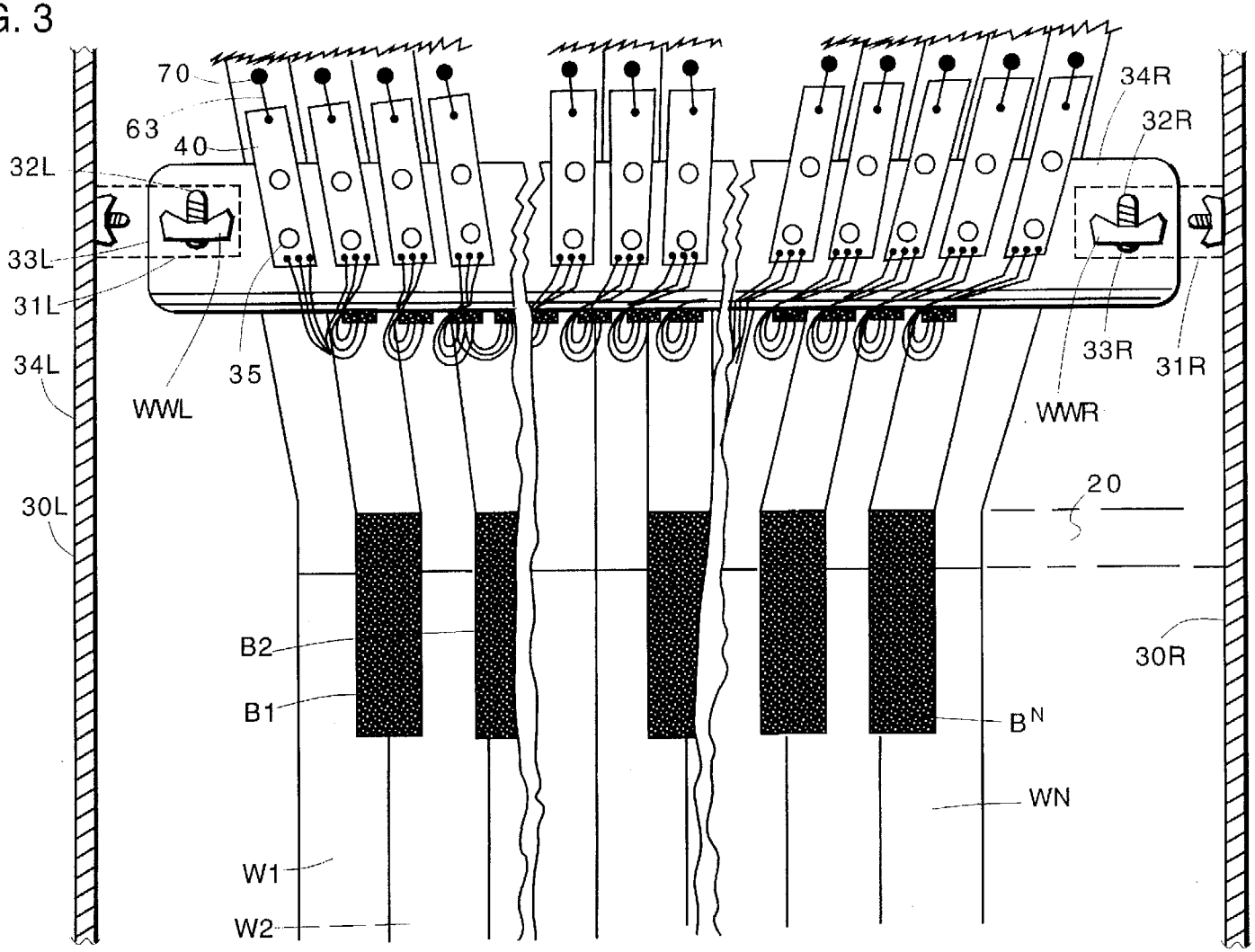
FIG. 3 is a perspective view from above of the keyboard showing the invention as applied to a piano key.

FIG. 1 illustrates a conventional upright acoustic piano having front legs 10, sides 11, a keyboard 12, fallboard 13, fallstrip 14, shelf drop 16, music shelf 17, lid drop 18 and lid 19. One of the great advantages and beauties of the present invention is that the beauty, tonal quality, and structural strength of these old musical instruments is not in any way changed. While various boxes containing modules for different MIDI devices may be placed beside the instrument or on the lid, the overall outward appearance of the instrument remains unchanged. While an upright piano has been illustrated, the invention is equally applicable to other types of pianos, such as the grand.

The MIDIfication of the instrument takes place below the music shelf 15 and behind the balance rail 20 shown in FIG. 2. FIG. 2 is a partial top plan view of a conventional piano instrument with the keys beyond the portion of a keyboard called the balance rail 20 resting on the back rail cloth BRC.

As shown, in many pianos, the keys K are all parallel on the portion of the keys frontward of the balance rail. Rearward of or behind the balance rail 20, the keys K1, K2 . . . K88 angle, typically in octaves. Thus, there will be eight keys angled to the left, some of the key octaves go parallel straight backwards beyond the balance rail, and on the right side the keys angle rightwardly in octaves to the right of the center of the piano. This situation is called key angulation. Where the split is varies widely among different piano manufacturers and in order to accommodate these different manufacturers, the present invention provides key sensor switch assemblies which are adjustable in a horizontal plane and have key sensor probes which are vertically and individually adjustable in a horizontal plane to accommodate the unevenness of the old piano keys.

Referring now to FIG. 3, the invention is shown as applied to a piano keyboard instrument having individual piano keys with the white keys being identified as W1, W2, W3 . . . WN, and the black keys being labeled B1, B2 . . . BN. As shown, the left white keys W1, W2 and the left black keys B1, B2 are part of an octave in which the key portions behind the balance rail 20 angle to the left. The middle keys or keys in the center of the piano have their actuating key portions beyond balance rail 20 extending straight backwards to the hummer actuation mechanism (not shown) and the rightmost key portions beyond the balance rail are angled off to the right in octave groups. Thus, the octaves may have different angulations, as illustrated.

Figure 7A:
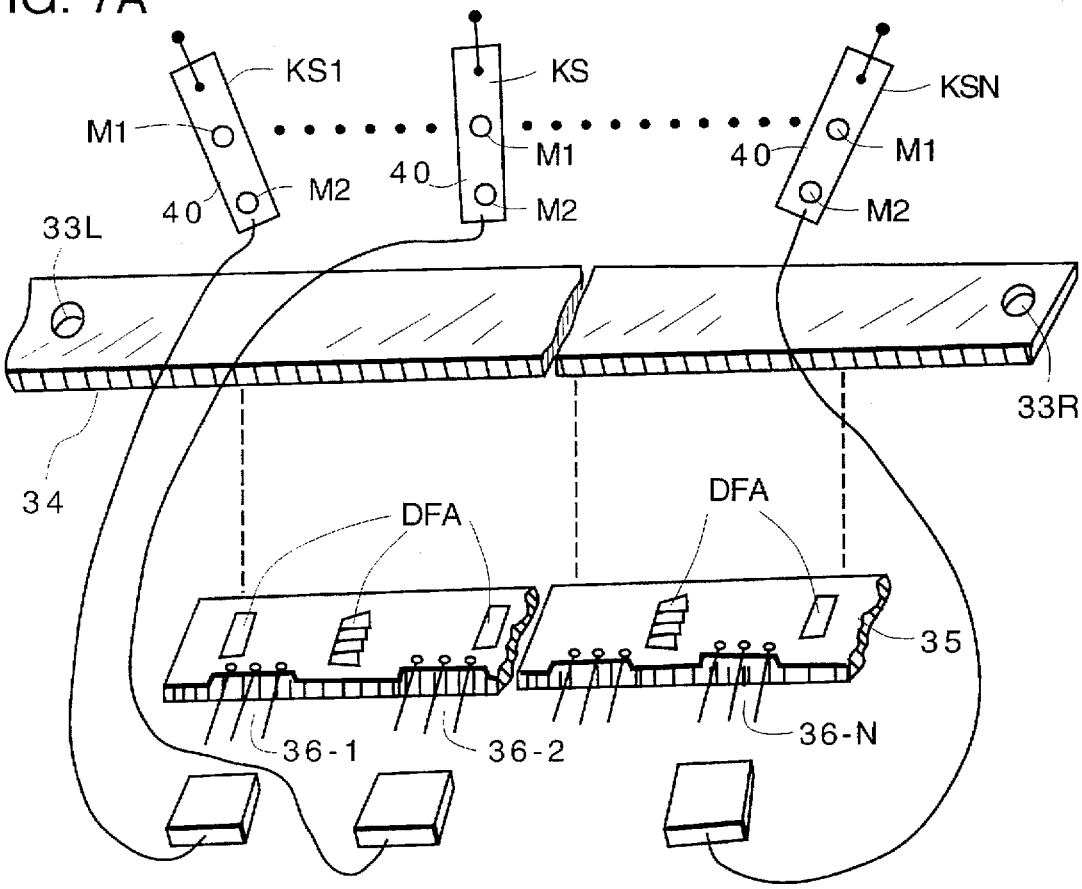
FIG. 7A is an exploded view showing the metal mounting strip, key sensor strip printed circuit board and the individual key sensor switches for several keys.
Figure 7C:
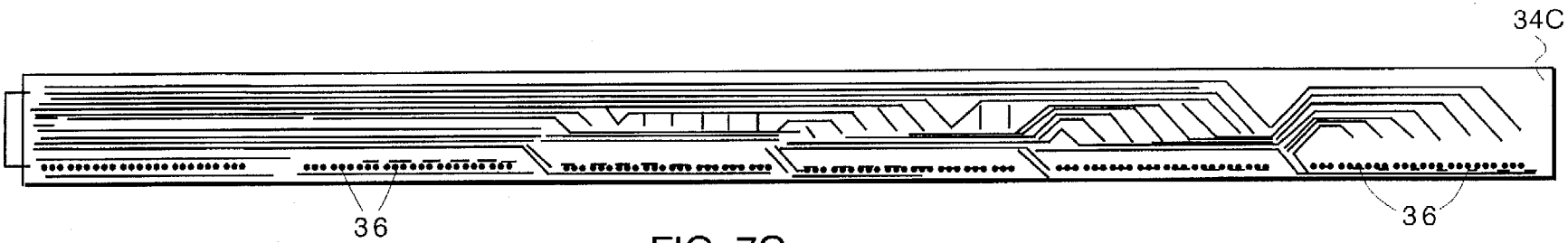
FIGS. 7B and 7C are examples of the circuit patterns on the printed circuit boards.
Figure 7B:
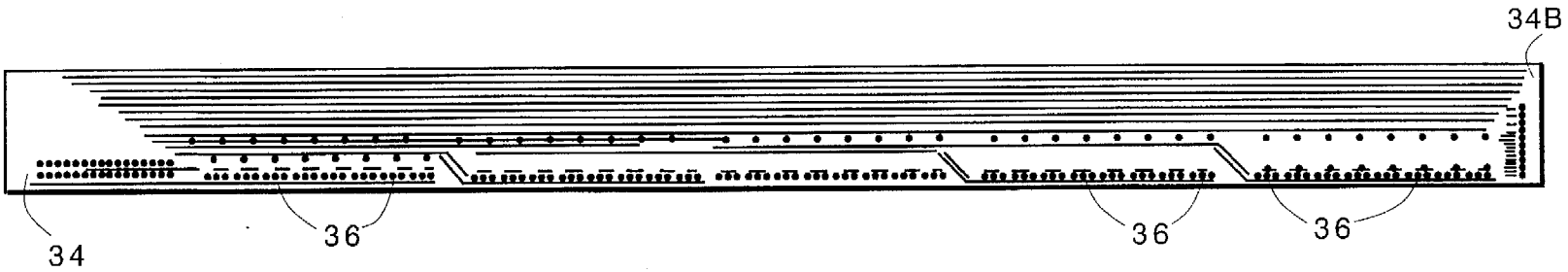

A pair of mounting angles 31L and 31R are fastened by wing nuts to post members 29L and 29R mounted on left sidewall 30L and right sidewall 30R, respectively, as disclosed in my above-identified patents. Each angle (31L and 31R) has an upstanding screw 32L and 32R which pass through holes 33L and 33R of sensor mounting bar or plate 34, and wing nuts WNL and WNR leave the bar 34 in place. Sensor mounting bar 34 is a rigid metal strip which has secured or otherwise fastened to the underside or lower surface thereof, key sensor strip printed circuit board 35, best seen in FIG. 7. In the embodiment illustrated, printed circuit strip or circuit board 35 is secured to the undersurface of mounting bar 34 by means of a double-faced adhesive DFA. An epoxy, screws, rivets, clips and the like can be used. As shown in FIG. 7A, the outer edge of the printed circuit board is provided with a three-conductor male prongs constituting connectors 36, there being a set of prongs for connector 36 for each key sensor switch KS1, KS2 . . . KS88. Exemplary circuit patterns for the circuits carried on printed circuit boards 35 are illustrated in FIGS. 7B and 7C. These circuits are illustrated diagrammatically and described in my above-referenced patents and need not be described in detail herein.

Each of the key sensor switches KS1, KS2, KS3 . . . KS88 (for an 88 keyboard) is provided with a mounting mechanism for allowing key sensor switch adjustments in a generally horizontal plane so that the individual key sensor switches can be adapted to accommodate the different manufacturers split on where the angulations for the different keys begin. In a preferred embodiment, pairs of rare earth permanent magnets M1 and M2 are used to magnetically secure the key sensor switch to the metal mounting plate 34. Thus, one of the features of the metal mounting bar 34 is that it coacts with the magnets M1 and M2 to securely hold the key sensor switches in proper orientation with respect to the piano key portion with which it is associated.

For convenience of manufacture, the key sensor switch circuit board 35 is fabricated in two (or more) sections with five octaves on one section and six octaves (for an 88 key piano, but in some cases it may not be necessary to sense actuation of all keys) on another section and they are interconnected by a flexible cable ribbon (not shown).

Figure 4:
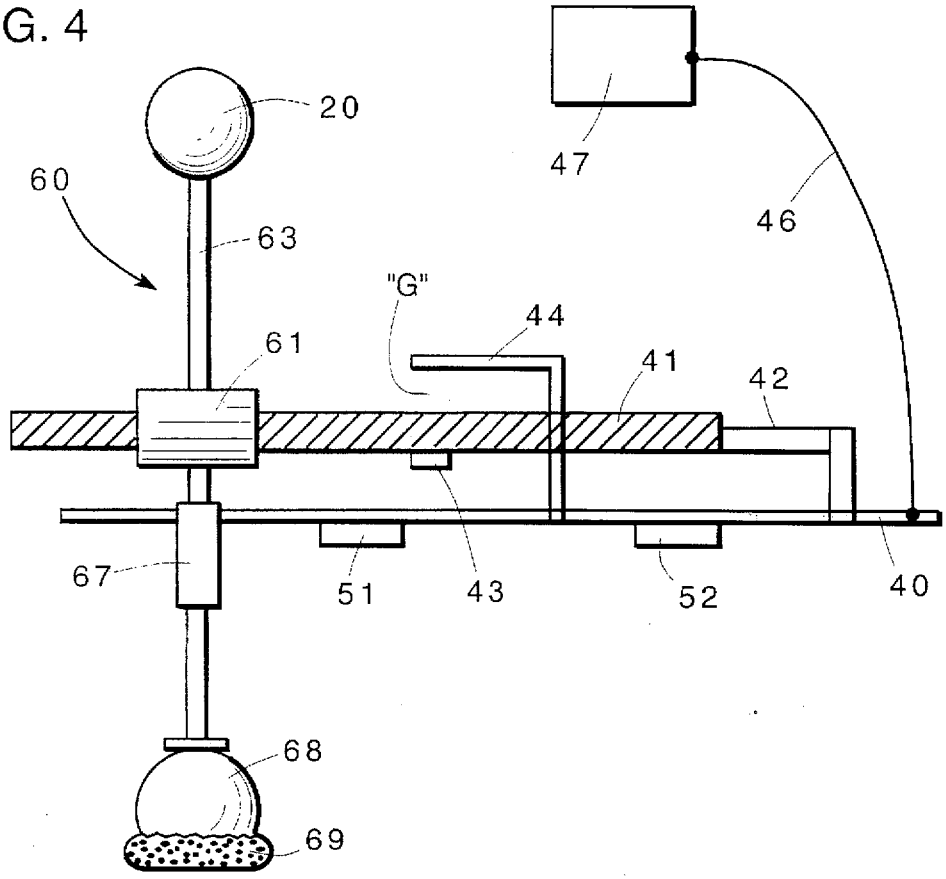
FIG. 4 is a side elevational view of a key sensor switch incorporating the invention.
Figure 6:
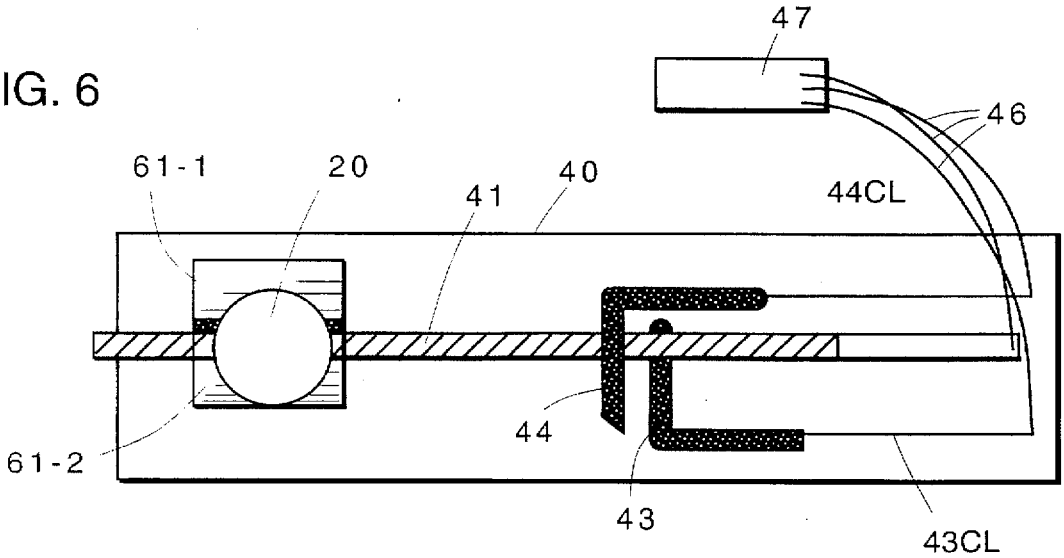
FIG. 6 is a top plan view of a key sensor switch shown in FIG. 5.

Referring to FIGS. 4, 5 and 6, each key sensor switch KS includes its own small printed circuit board body member 40, each of which is about 10 millimeters wide and about 45 millimeters long and made of conventional rigid circuit board material. As shown, the conductive spring element 41 (which in this embodiment is a helically coiled spring) rests on a lower conductive member 43 which is a rigid conductor and supported from circuit board 40 and has a printed circuit conductive lead 43CL which extends to the edge of the circuit board 40. An upper conductor 44 is spaced above the conductive spring 41 and is likewise rigid and spaced a distance to form a gap "G" such that the conductive spring element 41, when deflected or actuated in a manner to be described later herein by the actuation of the piano key, breaks the circuit with conductor element 43, traverses the gap "G" and makes conductive contact with conductor element 44. The gap between the two conductor 43 and conductor 44 serves as a timing space between the two conductor elements so that when the conductor element 41 breaks contact with conductor element 43, a conventional timing circuit (not shown) is initiated which determines the time of travel of conductive spring member between conductor element 43 and conductor element 44. When the conductor element 44 is contacted by conductive spring element 41, the gap travel time is determined. This gap travel time is a function of the expression effects entities by the musician during the striking of the particular key associated with that element. The two conductor elements 43 and 44 and the conductive spring 41 are brought to the edge in conventional printed circuit fashion by conductor 43CL and 44CC, and electrical wire harness 46 couples the conductors to a female plug 47 which plugs into conductive male prongs 39 (see FIG. 7A).

A pair of rare earth magnets 51 and 52 are adhered to the undersurface of printed circuit board 40, and these magnets secure the key switch assembly to the metal plate 38. These magnetic couplings or connections of each key switch assembly to the mounting bar or strip 34 permits easy positioning and accommodation of the different angulations of the keys of the piano beyond the balance rail. Obviously, they can be easily replaced for service or repair purposes. Thus, as shown in FIG. 3, the individual key sensor switches KS1, KS2 . . . KS88 can be individually adjusted to accommodate the different angulations of the different keys regardless of the octave that the key switch may be located in. If the piano is one of the type in which there is no angulations, then the key switches can be easily oriented to accommodate this type piano. The magnets are quite strong. While one magnet would be sufficient to hold the key sensor switch in position, in this embodiment, two spaced magnets are preferred. It is obvious that functional equivalents are not excluded.

In order to accommodate possible unevenness in the level of the individual keys, the mechanical connection or coupling between the keys and the conductive spring member 41 is accomplished by probe sensor assemblies 60. Each probe sensor includes a friction mounting spring scroll 61 which includes a first loop 61L and a second loop 61-2 which are joined by a base member 60B. The loops 61L and 61R are spaced so that probe rod 63 is frictionally grasped by the two-spring coil 61-1 and 61-2. Coil spring 61-2 encircles conductive spring element 41 and is held in position by an insulating sleeve 65. Probe sensor rod 63 passes through a hole 64 in base member 61B and through an aperture 66 in circuit board 40. A collar or sleeve 67 guides the probe rod 63.

The lower end of the key stem probe 63 has a key-engaging structure comprised of a key button 68 and a felt member 69. A bulbous member 70 is fixed on the upper end of key stem 63. Referring now FIGS. 3 and 4, collectively, with the key sensor switches KS-1, KS-2 . . . in the positions as indicated, the individual push knobs or bulbous members 70 are pushed/pressed down until the felt end 69 just engages the key switch that it is associated with. When the push knob 70 is pressed downwardly, connective spring member 41 is pushed downwardly and the scroll spring 61 engages the surface of circuit board 40. Further pushing of the bulbous push knob 70 causes the key stem 63 to slide in the spring grip between spring elements 61-1 and 61-2 and until it is in a position that it is when the felt tip just engages the piano key portion. The spring element then retains the key stem 63 in this adjusted position so that anytime the musician pressed the key, there is no gap between the key and the felt tip 69.

Thus, immediately upon pressing the key by the musician, the piano key pivots on the balance rail and the key member moves upwardly (opposite the direction that the musician is pressing down), and this raises the coil conductive spring 41 and thereby break electrical contact with conductor element 43. As the conductive spring 41 moves upwardly and away from contact with conductive element 43 and into engaging electrical contact with conductor element 44, the gap timing circuit (not shown) times the movement so as to get a precise measure of the expression affect imparted to that key by the musician. This thereby constitutes the break-gap make switch disclosed in my above-identified patents.

Summarizing, the invention incorporates a rigid bar member which supports a plurality of key sensor switches which are individually adjustable in a horizontal plane to accommodate different piano key angulations as provided by different piano manufacturers. Each key sensor switch includes a key-engagement probe member and friction member for securing the key-engagement probe on the free end of the spring so that each probe can be pushed into its friction retention mounting and its sensing engagement with its respective key on the old keyboard and be retained in proper and precise sensing position to thereby accommodate uneven wear in the keys. The invention thus facilitates the MIDIfying or bringing up to MIDI standards old keyboard musical instruments and provides key actuation sensors which are individually adjustable in a horizontal plane and vertically adjustable to accommodate uneven wearing of keys of the keyboard instrument. It is also clear that the system can be applied to existing musical instruments by untrained and relatively technologically unsophisticated personnel. It does not require the removal of the individual keys or the keyboards from the instrument, nor does it require cutting slots, boring holes and the like for the sensors. Since the cost is in the hardware and the installation cost is practically nil, the system is of low-cost.

Figure 8:
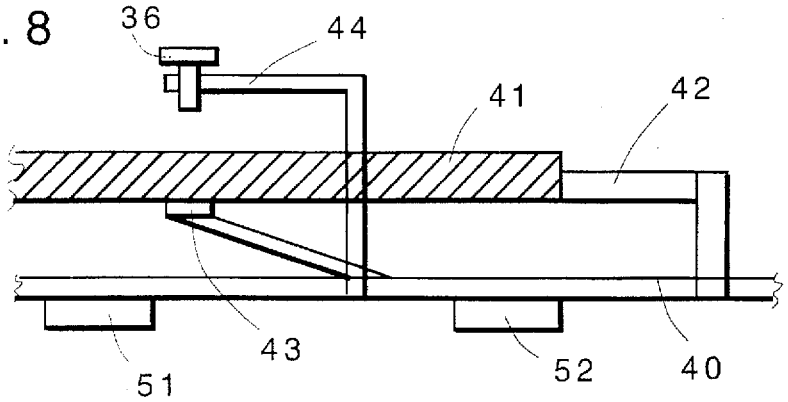
FIG. 8 illustrates a further embodiment of the invention.

In the embodiment shown in FIG. 8, upper conductor element 44 has a set screw 60 which can be used to adjust the size of the gap "G". The time of key contact can be adjusted from the time the key is touched by the musician to the time the key bottoms out and constitutes a note attack feature of the invention.

While there has been shown and described preferred embodiments of the invention, it will be appreciated that various other embodiments, adaptations and modifications and changes to the invention will be readily apparent to those skilled in the art and can be made with departing from the spirit of the invention or the scope of the appended claims.

What is claimed is:

1. In a system for rejuvenating conventional old keyboard musical instruments to MIDI standards, said system having one or more linear arrays of key actuation sensors for sensing key actuation and expression effects by a musician and a mounting bar for mounting said one or more linear arrays of key actuation sensors above the keyboard and behind the balance rail of said musical instrument to convert each key actuation and expression effect of the musician to first coded electrical signals, respectively, the improvement comprising:

said mounting means including a magnetically attractive mounting bar, each said key actuation sensor including a mounting plate printed circuit board, magnet means for connecting said printed circuit board to said magnetically attractive mounting bar and each said key actuation sensor including a key actuation sensing probe, whereby each said key actuation sensor can be adjusted in a horizontal direction relative to said magnetically attractive mounting bar and maintained in position by said magnet means and said magnetically attractive bar.

2. A system for rejuvenating conventional old keyboard musical instruments as defined in claim 1 wherein each said key actuation sensor probe includes an electrically conductive spring, means for cantilever mounting said electrically conductive spring on said printed circuit board, said conductive spring having a mounting end fixedly mounted on said circuit broad and a free end, a first conductor member positioned below and in electrical contact with said conductive spring and a second conductor member mounted a distance above said conductive spring such that said first and second conductor members and said conductive spring constitute a break-gap-make switch, each said break-gap-make switch including a key engagement probe member and friction means securing said key engagement probe member on said free end of said conductive spring, whereby each key engagement probe member can be pushed into sensing engagement with its respective key on said old keyboard musical instrument and retained in said sensing engagement thereby accommodating uneven wear in said keys.

3. The system defined in claim 2 wherein said second conductor member includes means for adjusting the size of the gap in said break-gap-make switch.

4. The system defined in claim 2 wherein said friction means includes a pair of scrolled springs bearing on opposing sides of said key engagement probe member.

5. The system defined in claim 2 including a guide sleeve member secured to said printed circuit board for guiding said key engagement probe member.

6. The system defined in claim 4 wherein one of said pair of scroll springs includes an insulator between said one of said pair of scroll springs and said conductive spring member.

7. In a system for rejuvenating conventional old keyboard musical instruments to MIDI standards, said system having one or more linear arrays of key actuation sensors for sensing key actuation and expression effects by a musician and a mounting bar for mounting said one or more linear arrays of key actuation sensors above the keyboard and behind the balance rail of said musical instrument to convert each key actuation and expression effect of the musician to first coded electrical signals, respectively, the improvement comprising:

said mounting means including a mounting bar, each said key actuation sensor including a mounting plate printed circuit board, means adjustably connecting said printed circuit board to said mounting bar and each said key actuation sensor including a key actuation sensing probe, whereby each said key actuation sensor can be adjusted in a horizontal direction relative to said mounting bar to accommodate any key angulation behind said balance rail.

8. In a system for rejuvenating conventional old keyboard musical instruments to MIDI standards, said system having one or more linear arrays of key actuation sensors, printed circuit board means carrying said key actuation sensors for sensing key actuation and expression effects by a musician, means for mounting said one or more linear arrays above the keyboard and behind the balance rail of said musical instrument to convert each key actuation and expression effect of the musician to binary coded electrical signals, respectively, each said key actuation sensor including means for individually vertically adjusting said sensor relative to said means for mounting, the improvement in said means for vertically adjusting said sensor comprising:

each said key actuation sensor including a cantilever mounted electrically conductive spring, said spring having a mounting end mounted on said circuit board and a free end, a first conductor member positioned below and in electrical contact with said spring and a second conductor member mounted a distance above said spring such that said first and second conductor members and said spring constitute a break-gap-make switch, each said switch including a key engagement probe member and friction means securing said key engagement probe member on said free end of said spring, whereby each key engagement probe member can be pushed into sensing engagement with its respective key on said old keyboard musical instrument and retained in said sensing engagement thereby accommodating uneven wear in said keys.

9. The system defined in claim 8 wherein each said key actuation sensor includes means for adjusting said key actuation sensor in a horizontal plane relative to said keyboard to accommodate any key angulation.

10. In a method for rejuvenating conventional old pianos having keyboards with keys pivoted on a balance rail to MIDI standards in which one or more linear arrays of key actuation sensors on printed circuit board means sense key actuation and expression effects by a musician, mounting said actuation sensors above the keyboard and behind the balance rail of said old piano to convert each key actuation and expression effect of the musician to binary coded electrical signals, the improvement comprising:

adjusting said key actuation sensors in a horizontal plane to accommodate key angulation differences.

11. The method defined in claim 10 wherein each key actuation sensor includes a vertically adjustable key actuation sensor probe and said method includes the step of vertically adjusting said key actuation sensor probes to accommodate any unevenness in the keys of said old piano.

12. A system for rejuvenating old pianos having piano keys pivoted on a balance rail, an array of key sensor switches, means for mounting said array of key sensor switches above said piano keys so that they are individually adjustable in a horizontal plane to accommodate varying angulations of the keys behind the balance rail.

13. The system defined in claim 12 wherein each key sensor switch includes a friction retained, vertically adjustable sensor probe engaging its respective piano key.

14. In a system for midifying keyboard musical instruments wherein said system includes one or more arrays of key movement sensors for sensing key movement and expression effects by a musician and a mounting means for mounting said one or more linear arrays of key movement sensors above the keyboard to convert each key actuation and expression effect of the musician to coded electrical signals, respectively, the improvement comprising:

said mounting means including a magnetically attractive mounting bar, each said key sensor including a mounting plate printed circuit board, magnet means for connecting said printed circuit board to said magnetically attractive mounting bar, each said key actuation sensor including a key movement sensing probe, whereby each said key actuation sensor can be adjusted in a horizontal direction relative to said magnetically attractive mounting bar and maintained in position by said magnet means and said magnetically attractive bar.

15. A system for midifying piano keys comprising an array of key sensor switches, means for mounting said array of key sensor switches above said piano keys so that they are individually adjustable in a horizontal plane to accommodate varying angulations of the keys, respectively, and means for scanning said key switches for sampling the key switches and producing coded electrical signals corresponding to key actuations of the individual keys of said keyboard.

* * * * *